US012745861B2

(12) United States Patent
Rasciuc

(10) Patent No.: US 12,745,861 B2
(45) Date of Patent: Sep. 29, 2026

(54) BABY CARRIER FOR CARRYING AND DEVELOPING A BABY ON A BODY OF A PERSON; USE OF A BABY CARRIER FOR WEARING THE BABY CARRIER ON A BODY OF A PERSON

(71) Applicant: STICHTING TOT BEHEER EN ONTWIKKELING VAN INTELLECTUELE EIGENDOM VAN "BABYMOON", Nijmegen (NL)

(72) Inventor: Georgeta Rasciuc, Nijmegen (NL)

(73) Assignee: STICHTING TOT BEHEER EN ONTWIKKELING VAN INTELLECTUELE EIGENDOM VAN "BABYMOON", Nijmegen (NL)

( * ) Notice: Subject to any disclaimer, the term of this patent is extended or adjusted under 35 U.S.C. 154(b) by 89 days.

(21) Appl. No.: 18/027,898

(22) PCT Filed: Sep. 24, 2021

(86) PCT No.: PCT/NL2021/050576
§ 371 (c)(1),
(2) Date: Mar. 22, 2023

(87) PCT Pub. No.: WO2022/066012
PCT Pub. Date: Mar. 31, 2022

(65) Prior Publication Data

US 2023/0363551 A1 Nov. 16, 2023

(30) Foreign Application Priority Data

Sep. 28, 2020 (NL) ..... 2026561

(51) Int. Cl.
*A47D 13/02* (2006.01)

(52) U.S. Cl.
CPC ..... *A47D 13/025* (2013.01)

(58) Field of Classification Search
CPC ..... A41B 13/06; A47D 13/02; A47D 13/025; A47D 13/08
(Continued)

(56) References Cited

U.S. PATENT DOCUMENTS

2005/0076856 A1 4/2005 Bruck et al.
2008/0149674 A1* 6/2008 Hiniduma-Lokuge ..... A47D 13/025 224/159
(Continued)

FOREIGN PATENT DOCUMENTS

CA 2821329 A1 1/2015
DE 202011103052 U1 * 10/2011 ..... A47D 13/025
(Continued)

OTHER PUBLICATIONS

KR-101359888-B1 Translation, Yim, Feb. 7, 2014 (Year: 2014).*
(Continued)

*Primary Examiner* — Nathan J Newhouse
*Assistant Examiner* — Matthew T Theis
(74) *Attorney, Agent, or Firm* — KDW Firm PLLC

(57) ABSTRACT

A baby carrier includes a body panel providing a seat and a back support for the baby; a waist support connected to the body panel for fastening the body panel to a person's waist; a pair of shoulder fastening members connected to the body panel for fastening over the person's shoulders; side fastening members connected to the body panel member, and a fastener. Each shoulder fastening member includes a shoulder strap; and a belt and a fastener for releasably connecting the belt to one of the side fastening members or to the fastener of the shoulder fastening member. The waist support and body panel enable selectively adjusting a body height support length of the body panel, by folding or rolling the lower end of the body panel the body height support
(Continued)

length before tightening the waist support including the body panel to the waist of the person.

22 Claims, 9 Drawing Sheets

(58) Field of Classification Search
USPC ..... 224/158–160
See application file for complete search history.

(56) References Cited

U.S. PATENT DOCUMENTS

| | | | | |
|---|---|---|---|---|
| 2011/0240693 | A1* | 10/2011 | Parness | A47D 13/025 224/160 |
| 2020/0163466 | A1* | 5/2020 | Telford | A47D 13/086 |
| 2022/0087444 | A1* | 3/2022 | Farrell | A47D 13/025 |

FOREIGN PATENT DOCUMENTS

| | | | | | |
|---|---|---|---|---|---|
| DE | 202011104489 | U1 | * | 1/2013 | A47D 13/025 |
| GB | 2548135 | A | * | 9/2017 | A47D 13/025 |
| JP | 2003102598 | A | * | 4/2003 | A47D 13/025 |
| JP | 2013500107 | A | * | 1/2013 | |
| KR | 101359888 | B1 | * | 2/2014 | |
| KR | 101432450 | B1 | | 8/2014 | |
| KR | 101521766 | B1 | | 5/2015 | |

OTHER PUBLICATIONS

DE-202011104489-U1 Translation, Jan. 10, 2013 (Year: 2013).*
DE-202011103052-U1 Translation, Oct. 13, 2011 (Year: 2011).*
JP-2013500107-A Translation, Jan. 7, 2013 (Year: 2013).*
JP-2003102598-A Translation, Kimura Yuko, Apr. 8, 2003 (Year: 2003).*
International Search Report and Written Opinion mailed Jan. 18, 2022, for Application No. PCT/NL2021/050576 (15 pages).

* cited by examiner

BABY CARRIER FOR CARRYING AND DEVELOPING A BABY ON A BODY OF A PERSON; USE OF A BABY CARRIER FOR WEARING THE BABY CARRIER ON A BODY OF A PERSON

This application is a national stage filing under 35 U.S.C. 371 of pending International Application No. PCT/NL2021/050576, filed Sep. 24, 2021, which claims priority to Netherlands Patent Application No. 2026561, filed Sep. 28, 2020, the entirety of which applications are incorporated by reference herein.

FIELD OF INVENTION

The field of the invention relates to a baby carrier for carrying and developing a baby on a body of a person. The invention further relates to a use of a baby carrier according to the present invention for wearing the baby carrier on a body of a person.

BACKGROUND

A baby carrier is generally known for carrying a baby, an infant or a young child on a body of a person. The baby carrier has a body panel member shaped for providing a seat for a baby and a back support for the baby. In general, the baby carriers are, depending on a size and/or shape of the body panel member, mainly usable for a certain size of the baby or young child only. For example a newborn baby has a body size considerably smaller than a child of at least one year old.

Moreover, it may be desired for baby carriers to be fastened in at least a front position of the baby, and in a back position of the baby, all with respect to the body of the carrying person.

It has been found, that known baby carriers are not suitable to position the baby at a comfortable level for the baby and the carrying person in both of these front and back positions with respect to the carrying person. For example, in a front position it may be desired to carry a baby at a height level, wherein the carrying person may look over the head of the baby. Furthermore, in a back position it may be desired to carry the baby or young child at a height level, wherein the baby or young child may look over the shoulder of the carrying person.

Additionally, known carriers follow a conventional design approach whereby the weight of the baby is supported by the lower rail. This means that the baby's weight is concentrated at the bottom and can be harmful to your back and shoulders.

Moreover, known carriers do not provide adequate support for growing babies for each step of the spine development of the baby. Especially for a newborn younger than 6 months, the support is not adequate, which disturbs the muscle and spine development of the baby.

Moreover, a desire exists to provide a baby carrier which has a simple a design and provides an easy fastening of the baby carrier to the carrying person in the front position and in the back position, respectively, while providing a comfortable position for carrying the baby by the carrying person and supporting the physical development of the growing baby.

SUMMARY OF THE INVENTION

Embodiments of the invention aim to improve the baby carrier for carrying and developing a baby and/or a young child on a body of a person, wherein the baby carrier has a simple design and provides an easy fastening of the baby carrier to the carrying person in the front position and the back position, respectively, while providing a comfortable position for carrying the baby and/or a young child by the carrying person.

According to a first aspect of the invention there is provided a baby carrier for carrying and developing a baby on a body of a person, said baby carrier comprising:

- a body panel member shaped for providing a seat for a baby and a back support for the baby, wherein the body panel member comprises a support layer mainly constituted by a woven fabric;
- a waist support member connected to a lower end of the body panel member for fastening the body panel member to a waist of the person and comprising a waist textile strap arranged on at least one side of the body panel member along at least a part of the waist support member, wherein the waist textile strap comprises a support layer mainly constituted by a woven fabric;
- a pair of shoulder fastening members connected to an upper end of the body panel member and arranged for fastening the body panel member over each shoulder of the person, respectively;
- a pair of side fastening members, each side fastening member being connected to a side of the body panel member, respectively, and comprising a fastening means, wherein the fastening means of one side fastening member has a male element and the fastening means of another one side fastening member has a corresponding female element;
- wherein each shoulder fastening member comprises: a shoulder strap arranged for extending over a shoulder, respectively, wherein the shoulder strap comprises a support layer constituted by a woven fabric; and a belt and a fastening means mounted onto the belt for releasably connecting the adjustable belt to one of the side fastening members or to the fastening means of another one of the shoulder fastening member, wherein the fastening means of one shoulder fastening member has a male element and the fastening means of another one shoulder fastening member has a corresponding female element and wherein the fastening means is slidably arranged for adjusting a belt length between the fastening means and the shoulder strap;
- wherein the waist support member including the body panel member are arranged for selectively adjusting a body height support length(S) of the body panel member, by selectively folding or rolling the lower end of the body panel member in the direction of the body height support length(S) before tightening the waist support member including the body panel member to the waist of the person.

Advantageous Effects of the Invention

The baby carrier has a simple design and provides an easy fastening of the baby carrier to the carrying person in the front position and the back position, respectively, while providing a comfortable position inside the hammock formed by the body panel member for carrying the baby and/or a young child by the carrying person. The combination of a female element on one shoulder fastening member and a male element on the other shoulder fastening member surprisingly supports a faultless and easy fastening of the baby carrier to the carrying person. The combination with the pair of side fastening members leads that the user can easily select from several different ways of using the baby carrier based on the development of the baby in age, size and physical condition. Thus, the baby carrier offers multiple buckling options for front, hip and back carries for complete adjustability and even weight distribution without pressure points.

(Top Rail Support and Hip Support)

The baby carriers according to the invention provide that the main support line for the baby lies on the top rail with complete adjustability and excellent weight distribution without pressure points. Specifically, wide unpadded shoulder straps may be provided that cap the shoulders and fastening means, such as buckles, that tighten to position the baby in a firm upright position to evenly distribute the weight on the shoulders and hips. Together with the wide hammock, the baby's hips are supported in the safe M-position—the natural spread-squat positioning of the baby. The adjustment body height support length(S) of the body panel member enhances to get the right level of support required for the size of the baby (1.5-15 kg). Because of the strong top rail support system, one can unbuckle the waist support member and the baby will still be in-position whilst the TICKS safety rules are observed throughout the carrying period. TICKS Safety rules are known to include Tight, In view at all times, Close enough to kiss, Keep chin off the chest, and Supported back. This mechanism of the strong top rail support positions the wearer's back to be upright preventing back and shoulder problems.

In addition, the baby carrier can easily be adjusted to the desired shape for supporting and caring a baby in several stages of the development of the baby. In particular, the desired shape of the body panel member can be easily adjusted by the user such that the body panel member supports a spine shape of the baby. In this way a physical development of the baby is supported. The baby carrier is designed to support the natural C-shape curvature of the newborn baby, and grow with the baby for each step of the spine development. A newborn to independent sitting has a C shape spine, a baby developing from independent sitting to walking has a J shape spine, and a baby/or child developing from walking and further on has a S shape spine. The baby carrier is versatile in its design such that each of the spine developments can be supported, in combination with easy adjustments to the length of the spine.

In particular, when the design of the baby carrier is arranged for selectively adjusting a body height support length S of the body panel member to the required support length for the spine of the baby. The body height support length S of the body panel member is defined as being arranged substantially perpendicular to the longitudinal direction of the waist support member.

In addition, the baby carrier enhances a development of the hips of the baby.

The baby's knees are slightly higher than the buttocks in this baby carrier and the legs are spread from the hips which also produces a clinging reflex. This position is ideal for the development of the spine and hips of the baby.

According to the Hip Dysplasia Institute the risk of hip dysplasia or dislocation is greatest in the first few months of life. By six months of age, most babies have nearly doubled in size and/or have tripled their birth weight, the hips are more developed and the ligaments are stronger, so are less susceptible to developing hip dysplasia. To prevent this, the baby carrier hammock is designed to support the baby's hips in the safe M-position, supporting the spread-squat positioning of the baby.

The baby carriers may have wide unpadded shoulder straps that cap the shoulders and buckles that tighten to position the baby in a firm upright position to evenly distribute the weight on the shoulders and hips with most support coming from the top rail. This mechanism also positions the wearer's back to be upright preventing back and shoulder problems.

The baby carrier can be used on babies ranging from 1.5 kg to 15 kgs. One can roll the waist belt to adjust the carrier depth, and use the straps to get the right level of support required for the size of the baby.

(Body Panel Member-Hammock)

The body panel member including the fastening members provide a versatile hammock for providing a seat for a baby and a back support for the baby. In particular, when wearing the baby carrier, the waist support member may be at least partly placed between the baby and the front of the carrying person to form a hammock.

In specific examples, a width of the body panel member between the respective connections of the two side fastening members to the body panel member is in the range of 30 to 50 cm, preferably in the range of 35 to 45 cm.

The body panel member is flexible, foldable and rollable, which supports an easy adjusting of the body height support length(S) and an easy adjusting of the width of the body panel member for supporting the hips and legs of the baby.

In specific examples, a spanning width of the body panel member at a position for supporting the hips and legs of the baby may be adjusted to a width between 20 and 50 cm, e.g. by rolling and/or folding the body panel member near the lower end of the body panel member. In practice, a spanning width may adjust itself to the hips and legs of the baby. In specific examples of adjusting, the spanning width may be adjusted by hand to a desired spanning width.

In an exemplary embodiment, the woven fabric of the body panel member has a thickness, which is less than 5 mm.

(Additional Fastening Assembly on Body Panel Member)

In an exemplary embodiment, the body panel member further comprises a fastening assembly attached to an outer surface of the body panel member, the fastening assembly being arranged at a height level H below the side fastening members for releasably fastening the fastening means of the shoulder fastening members to the body panel member. The height level is substantially parallel to the body support length S of the body panel member.

In an exemplary embodiment, the fastening assembly comprises a pair of belt guiding loops attached to the outer surface of the body panel member, each belt guiding loop arranged for guiding and positioning a belt of one of the shoulder fastening members, when fastening the fastening means of the two shoulder fastening members to one another.

In an exemplary embodiment, the fastening assembly comprises a male of a fastening means and a female part of a fastening means for releasably fastening the fastening means of the shoulder fastening members to the body panel member.

(Adjusting Body Height Support Length S)

The design of the baby carrier is arranged for selectively adjusting a body height support length S of the body panel member to the required support length for the spine of the baby.

The body height support length S of the body panel member is defined as being arranged substantially perpendicular to the longitudinal direction of the waist support member.

The body height support length(S) of the body panel member may be adjusted by selectively folding or rolling the lower end of the body panel member in the direction of the body height support length(S) before tightening the waist support member including the body panel member to the waist of the person.

(Waist Support Member)

In particular, the waist support member including the body panel member are designed for selectively rolling the lower end of the body panel member in the direction of the body height support length(S).

In embodiments, the waist support member comprises at least one waist textile strap, the at least one waist textile strap being arranged on at least one side, preferably at both sides of the lower end of the body panel member, wherein the at least one waist textile strap is foldable and rollable. Preferably, the waist support member comprises a waist textile strap arranged at both sides of the lower end of the body panel member.

In particular, the waist textile strap extends along at least a part of the waist support member.

In preferred examples, the waist textile strap of the waist support member has an effective thickness, which is less than 5 mm, and wherein the waist textile strap comprises a support layer mainly constituted by a woven fabric.

In an embodiment, the waist textile strap is partly enclosed by layers of the body panel member. In particular, said waist textile strap extends at both sides of the body panel member along the waist support member.

In embodiments, the waist textile strap is a separate strap connected to the body panel member at the lower end of the body panel member. In an alternative embodiment, the waist textile strap is a part of the body panel member.

In specific examples, a height of the waist textile strap provides a folding distance for the body panel member, when turning the waist textile strap, which is at most 25% of the maximum body height support length of the body panel member, preferably at most 20% of the maximum body height support length of the body panel member.

In specific examples, a height of the waist textile strap is at most 15 cm, preferably at most 10 cm. In embodiments, the waist support member further comprises a belt and a fastening means arranged for releasable fastening the waist support member to the waist of the person.

Preferably, the waist support member comprises a waist textile strap arranged at one or both sides of the lower end of the body panel member, wherein the belt is connected to the one or two waist textile straps.

Said waist textile strap is arranged for rolling the lower end of the body panel member in the direction of the body height support length(S) when turning the belt of the waist support member a number of half turns (T) over before tightening. Said number of half turns (T) may be 0, 1, 2, 3, 4, etc.

(Shoulder Fastening Members)

In an exemplary embodiment, each shoulder strap is connected to the upper end of the body panel member.

In specific examples, the shoulder strap is connected to the body panel member such that the shoulder strap comprises a pleat, wherein said pleat is arranged for selectively adjusting a wearing width of the shoulder strap, when wearing the shoulder strap on a shoulder of the carrying person. Due to the pleat, the strap may automatically form locally two to three layers placed upon one another. The width of the shoulder strap may easily be adjusted from minimum 5 cm width to at least 15 cm width.

In specific examples, a width of the shoulder strap is at most 20 cm, preferably at most 18 cm. In specific examples, an extension length of the shoulder strap is at most 105 cm, preferably at most 85 cm, and at least 40 cm.

In specific examples, a length of the belt of the shoulder fastening member is at least 80 cm, preferably at least 100 cm.

(Side Fastening Members)

In an exemplary embodiment, a first side fastening member is connected to a first side of the body panel member and a second side fastening member is connected to a second side of the body panel member, the second side being opposite to the first side of the body panel member.

In preferred embodiments, the side fastening members are connected to the body panel member while being oriented at an acute angle between 30 and 60 degrees with respect to a direction of the body height support length(S) of the body panel member. The acute angle is defined as the angle with respect to the direction of the body height support length(S) going from the lower end of the body panel member to the upper end of the body panel member. The side fastening members are directed to the outside of the body panel member.

In an exemplary embodiment, each side fastening member comprises a belt having an adjustable length.

In exemplary embodiments, at least one side fastening member comprises a belt, wherein the fastening means is slidably mounted onto the belt for adjusting a belt length between the fastening means and the body panel member. Preferably, both side fastening members comprise a belt, wherein the fastening means is slidably mounted onto the belt for adjusting a belt length between the fastening means and the body panel member.

In specific examples, a length of the belt of the side fastening member (is at least 100 cm, preferably at least 150 cm. Preferably, the belt length between the fastening means and the body panel member is adjustable in the range between 0 cm and 150 cm, preferably between 0 cm and 100 cm.

(Woven Fabric)

In an exemplary embodiment, the support layer of at least one of the body panel member, the shoulder strap and the waist textile strap is mainly constituted by a number of layers of the woven fabric, preferably is mainly constituted by two layers of the woven fabric.

In an exemplary embodiment, the woven fabric has a weave structure selected from one of a diagonal weave, a double diagonal weave and a jacquard weave.

In an exemplary embodiment, the woven fabric may be any natural or synthetic woven yarn or any other type of yarn.

In specific examples, the woven fabric is predominantly made of a natural yarn, in particular a natural yarn selected from the group consisting of wool, cotton, linen, silk, and hemp, a silver coated yarn, in particular a silver coated yarn selected from the group consisting of silver coated wool, silver coated cotton, silver coated linen, silver coated silk, and silver coated hemp, a viscose yarn, in particular a viscose yarn made from a material selected from the group consisting of bamboo, coffee, wood, and seaweed, or a reflective nanoparticle coated yarn.

In an exemplary embodiment, the woven fabric comprises a yarn having a weight of at least 200 g/m, preferably of at least 300 g/m.

A woven fabric with a yarn having a weight of at least 200 g/m, preferably of at least 300 g/m, and a diagonal, a double diagonal, or a jacquard weave supports that a proper structural ergonomic support is provided for the carrying person and child as the child increases in height and weight. This also enables the baby carrier to maintain a compact size when folded, due to the strong structural integrity of the woven fabric of the baby carrier design.

(Other)

In an exemplary embodiment, at least one of the body panel member, the shoulder strap and the waist textile strap further comprises an inner contact layer comprising a fabric different from the support layer. The inner contact layer is arranged for contacting the baby and/or carrying person. The inner contact fabric may be suitably chosen based on at least one factor of softness, breathability, thermal regulation, washability, anti-bacterial, and anti-eczema qualities. This enables proper thermal regulation of the child in both hot and cold temperatures, increases the hygienic cleanliness and health of parent and child, can help reduce child eczema, and ensures long-term quality after many washes.

In an exemplary embodiment, at least one of the body panel member, the shoulder strap and the waist textile strap comprises at least one support layer of the woven fabric and an inner contact layer.

In a preferred embodiment, the waist textile strap is partly enclosed by layers of the body panel member. In an example, the body panel member comprises two support layers each support layer comprising a woven fabric. The two support layers enclose the waist textile strap. In another example, the body panel member comprises a support layer and an inner contact layer. The support layer and the inner contact layer enclose the waist textile strap.

(Fastening Means)

The fastening means may comprise mechanical fastening means and may comprise other fastening means, such as magnetic fastening means.

In an exemplary embodiment, the fastening means is selected from at least one of a buckle member, a clasp member, a press stud member, a magnet member and a plurality of male fastening elements capable of engaging with fibrous materials having a plurality of complementary female fastening elements. For example, a Velcro mechanical fastening means may be selected.

In an exemplary embodiment, the mechanical fastening means is selected from a male element and a female element.

In an exemplary embodiment, at least one of the fastening means is arranged for adjusting a belt length of the corresponding shoulder fastening member, the side fastening member and the waist support member between the fastening means and the body panel member.

(Sensor)

In an exemplary embodiment, the baby carrier according to the present invention further comprises at least one sensor selected from: a heart sensor for measuring a heart beat of the child carried by the baby carrier, a temperature sensor for measuring a temperature of the child carried by the baby carrier, an oxygen sensor for measuring a level of oxygen in the blood of the child carried by the baby carrier, a sensor for measuring a time of carrying the child in the baby carrier, an audio sensor for measuring a heart beating of the child carried by the baby carrier, a electrocardiogram sensor for measuring an activity of the heart of the child carried by the baby carrier, a blood pressure sensor for measuring a blood pressure of the child carried by the baby carrier, a weight sensor for measuring a weight of the child carried by the baby carrier, and a sensor for measuring a breathing of the child carried by the baby carrier.

In an example, the oxygen sensor for measuring a level of oxygen in the blood of the child carried by the baby carrier is a pulse oximeter sensor. In an example, the heart sensor for measuring a heart beat of the child carried by the baby carrier is a heart rate sensor.

In a particular embodiment, at least one sensor is held by the body panel member of the baby carrier.

In an exemplary embodiment, the baby carrier according to the present invention further comprises a control unit for receiving a sensor signal from at least one of the sensors: the heart sensor for measuring a heart signal of the child carried by the baby carrier, the temperature sensor for measuring a temperature of the child carried by the baby carrier, the oxygen sensor for measuring the level of oxygen in the blood of the child carried by the baby carrier, the sensor for measuring the time of carrying the child in the baby carrier and the sensor for measuring the breathing of the child carried by the baby carrier.

(Versatile Use of the Baby Carrier)

The combination of a female element on one shoulder fastening member and a male element on the other shoulder fastening member by design supports a faultless and easy fastening of the baby carrier to the carrying person. The combination with the pair of side fastening members leads that the user can easily select from several different ways of using the baby carrier based on the development of the baby in age, size and physical condition. Thus, the baby carrier offers multiple buckling options for front, hip and back carry for complete adjustability and even weight distribution without pressure points.

In another aspect of the present invention, a use is provided of a baby carrier according to the present invention for supporting a baby on a body of a person, comprising the steps of:

(i) optionally adjusting a body height support length(S) of the body panel member by folding and/or rolling the lower end of the body panel member in the direction of the body height support length(S), before tightening the waist support member including the body panel member to the waist of the person;

(ii) fastening the waist support member including the body panel member to the waist of the person;

(iii) placing the baby inside the baby carrier;

(iv) fastening the male fastening means of said one shoulder fastening member to the female fastening means of said another one side fastening member and the female fastening means of said another one shoulder fastening member to the male fastening means of said one side fastening member;

(v) supporting the shoulder fastening members on the shoulders of the person; and (vi) carrying the baby inside the baby carrier on the body of the person.

In a particular embodiment of the use, the baby carrier is carried in a front position with respect to the body of the person. In this position of the baby carrier, the baby or infant may be carried by the baby carrier at a height level, wherein the carrying person may look over the head of the baby.

In another aspect of the present invention, a use is provided of a particular baby carrier according to the present invention for supporting a baby on a body of a person, wherein the body panel member further comprises a fastening assembly attached to an outer surface of the body panel member, wherein the fastening assembly comprises a pair of belt guiding loops, the use comprising the steps of:

(i) optionally adjusting a body height support length(S) of the body panel member by folding or rolling the lower end of the body panel member in the direction of the body height support length(S), before tightening the waist support member including the body panel member to the waist of the person;

(ii) fastening the waist support member including the body panel member to the waist of the person;

(iii) placing the baby inside the baby carrier;

(iv) guiding each of the belts of the shoulder fastening members through at least one of the belt guiding loops attached to the outer surface of the body panel member;

(v) fastening the male fastening means of said one shoulder fastening member to the female fastening means of said another one shoulder fastening member;

(vi) supporting the shoulder fastening members on the shoulders of the person;

(vii) optionally fastening the male fastening means of said one side fastening member to the female fastening means of said another one side fastening member; and (viii) carrying the baby inside the baby carrier on the body of the person.

The body panel member of said particular baby carrier further comprises a fastening assembly attached to an outer surface of the body panel member, the fastening assembly being arranged at a height level below the side fastening members for releasably fastening the mechanical fastening means of the shoulder fastening members to the body panel member, wherein the fastening assembly comprises a pair of belt guiding loops attached to the outer surface of the body panel member, each belt guiding loop arranged for guiding and positioning a belt of one of the shoulder fastening members, when fastening the mechanical fastening means of the two shoulder fastening members to one another.

In a particular embodiment of the use, the baby carrier is carried in a back position with respect to the body of the person. In this position of the baby carrier, the baby or infant may be carried by the baby carrier at a height level, wherein the baby or young child may look over the shoulder of the carrying person.

In another aspect of the present invention, a use is provided of a particular baby carrier according to the present invention for supporting a baby on a body of a person, wherein the body panel member further comprises a fastening assembly attached to an outer surface of the body panel member, the fastening assembly being arranged for releasably fastening the fastening means of the shoulder fastening members to the body panel member, the use comprising the steps of:

(i) optionally adjusting a body height support length(S) of the body panel member by folding and/or rolling the lower end of the body panel member in the direction of the body height support length(S), before tightening the waist support member including the body panel member to the waist of the person;

(ii) fastening the waist support member including the body panel member to the waist of the person;

(iii) placing the baby inside the baby carrier;

(iv) fastening the male fastening means of said one shoulder fastening member to the fastening assembly and fastening the female fastening means of said another one shoulder fastening member to the fastening assembly, thereby attaching the shoulder fastening members to the outer surface of the body panel member;

(v) supporting the shoulder fastening members on the shoulders of the person;

(vi) optionally fastening the male fastening means of one side fastening member to the female fastening means of another one side fastening member; and (vii) carrying the baby inside the baby carrier on the body of the person.

The body panel member of said particular baby carrier further comprises a fastening assembly attached to an outer surface of the body panel member, the fastening assembly being arranged at a height level below the side fastening members for releasably fastening the mechanical fastening means of the shoulder fastening members to the body panel member.

In a particular example, the fastening assembly comprises a male part of a fastening means and a female part of a fastening means for releasably fastening the mechanical fastening means of the shoulder fastening members to the body panel member.

In a particular embodiment of the use, the baby carrier is carried in a back position with respect to the body of the person. In this position of the baby carrier, the baby or infant may be carried by the baby carrier at a height level, wherein the baby or young child may look over the shoulder of the carrying person.

BRIEF DESCRIPTION OF THE FIGURES

The accompanying drawings are used to illustrate presently preferred non-limiting exemplary embodiments of devices of the present invention. The above and other advantages of the features and objects of the invention will become more apparent and the invention will be better understood from the following detailed description when read in conjunction with the accompanying drawings, in which.

DESCRIPTION OF EMBODIMENTS

Figure 1:
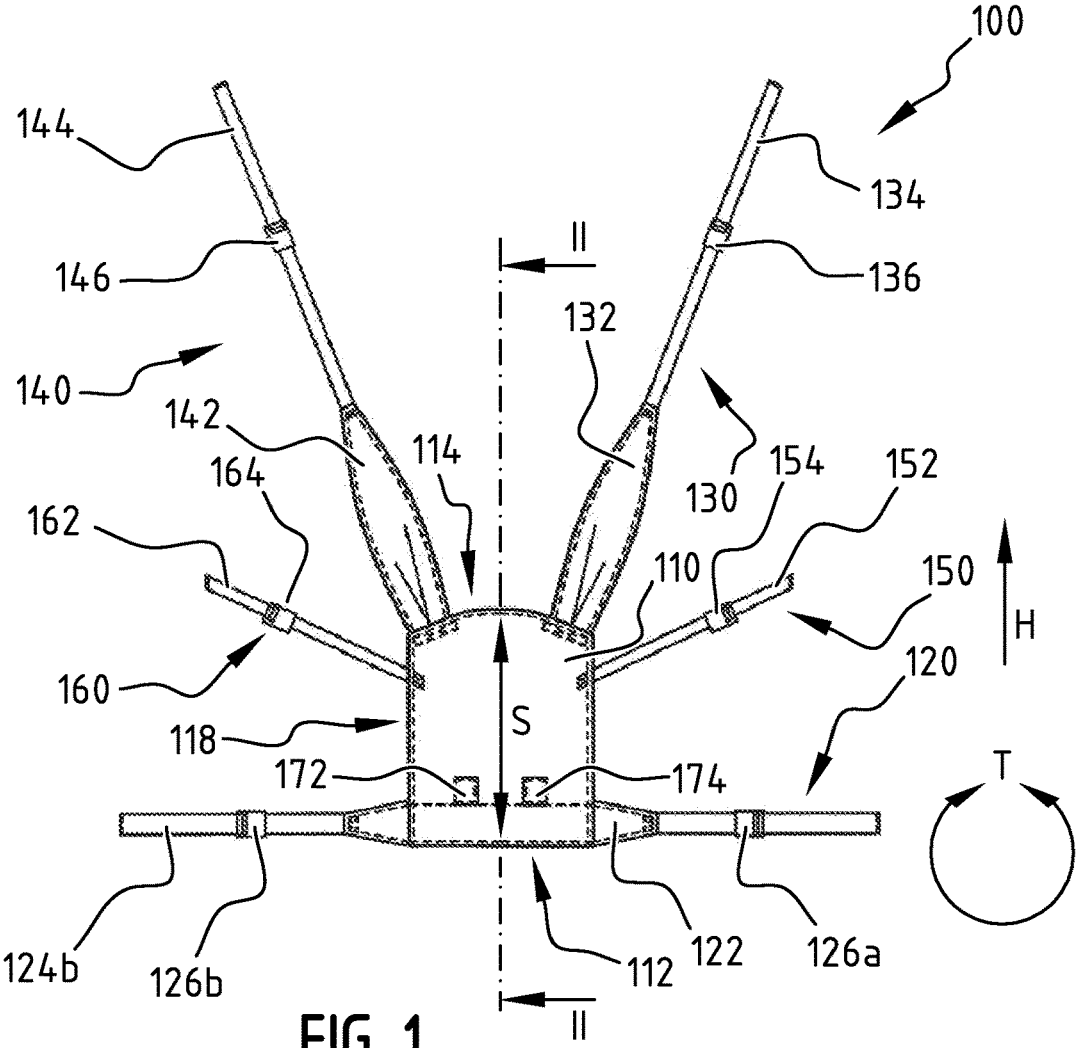
FIG. 1 illustrates schematically the parts of a baby carrier of an exemplary embodiment of the present invention.

FIG. 1 illustrates schematically a general exemplary embodiment of a baby carrier of an exemplary embodiment of the present invention. The baby carrier 100 comprises a body panel member 110, a pair of shoulder fastening members 130, 140, a pair of side fastening members 150, 160, and a waist support member 120.

The body panel member 110 is shaped for providing a seat for a baby and a back support for the baby, wherein the body panel member comprises a support layer mainly constituted by a woven fabric.

The waist support member 120 is connected to a lower end of the body panel member 112 for fastening the body panel member to a waist of the person and comprising a waist textile strap 122 arranged on at least one side of the body panel member along at least a part of the waist support member, wherein the waist textile strap comprises a support layer mainly constituted by a woven fabric.

The pair of shoulder fastening members 130, 140 is connected to an upper end of the body panel member 114 and arranged for fastening the body panel member 110 over each shoulder of the person, respectively.

Each side fastening member is connected to a side of the body panel member 116, 118, respectively, and comprises a mechanical fastening means 154, 164. The mechanical fastening means 154 of one side fastening member 150 has a male element and the mechanical fastening means 164 of another one side fastening member 160 has a corresponding female element. The side fastening members 150, 160 are connected to the body panel member 110 while being oriented at an angle between 30 and 60 degrees with respect to a direction H of the body height support length(S) of the body panel member 110. The first side fastening members 150 is oriented at an angle between 30 and 60 degrees in a clockwise direction (when looking at the outer front surface of the body panel member as shown in FIG. 1) with respect to a direction H of the body height support length(S). The second side fastening members 160 is oriented at an angle between 30 and 60 degrees in a counter-clockwise direction (when looking at the outer front surface of the body panel member as shown in FIG. 1) with respect to a direction H of the body height support length(S).

Each shoulder fastening member comprises a shoulder strap 132, 142, a belt 134, 144 and mechanical fastening means 136, 146. Each shoulder strap 132, 142 is arranged for extending over a shoulder, respectively. The shoulder strap comprises a support layer constituted by a woven fabric.

The mechanical fastening means 136, 146 is mounted onto the corresponding belt 134, 144 and is slidably arranged along the corresponding belt 134, 144 for adjusting a belt length between the fastening means and the shoulder strap. The mechanical fastening means 136, 146 is arranged for releasably connecting the adjustable belt to one of the side fastening members 150, 160 or to the mechanical fastening means 136, 146 of another one of the shoulder fastening member 130, 140. A belt length between the fastening means and the shoulder strap of the belt of the shoulder fastening member is adjustable in the range between 0 cm and 100 cm.

The mechanical fastening means 136 of one shoulder fastening member 130 has a male element and the mechanical fastening means 146 of another one shoulder fastening member 140 has a corresponding female element.

In the embodiments shown, each side fastening member 150, 160 comprises a belt 152, 162. The fastening means 154, 164 is slidably mounted onto the corresponding belt for adjusting a belt length between the fastening means 154, 164 and the body panel member 110.

A length of the belt of the side fastening member 150, 160 is at least 80 cm, preferably at least 100 cm, wherein the belt length between the fastening means 154, 164 and the body panel member 110 is adjustable in the range between 0 cm and 80 cm, preferably between 0 cm and 100 cm. In all of these embodiments shown, each of the mechanical fastening means 126*a*, 126*b*, 136, 146, 154, 164 comprises a buckle member. In particular, each of the mechanical fastening means 126*a*, 126*b*, 136, 146, 154, 164 comprises a male part of a buckle member or a female part of a buckle member.

In alternative embodiments, the fastening means 126*a*, 126*b*, 136, 146, 154, 164 is selected from at least one of a clasp member, a press stud member, a magnet member and a plurality of male fastening elements capable of engaging with fibrous materials having a plurality of complementary female fastening elements.

In the preferred embodiment shown, the male fastening means 136 of the shoulder fastening member 130 and the male mechanical fastening means 154 of the side fastening member 150 are both arranged at a same first side of the body panel member 110. Likewise, the female fastening means 146 of the other shoulder fastening member 140 and the female mechanical fastening means 164 of the other side fastening member 160 are both arranged at a same second side of the body panel member 110.

The waist support member 120 including the body panel member 110 are arranged for selectively adjusting a body height support length(S) of the body panel member 110, by selectively folding or rolling the lower end of the body panel member 112 in the direction of the body height support length(S) before tightening the waist support member 120 including the body panel member to the waist of the person.

In specific examples, the body support length S of the body panel member 110 is adjusted by turning the waist support member 120 a number of half turns T before connecting the waist support member including the body panel member 110 to the waist of the person.

In other specific examples, the body support length S of the body panel member 110 is adjusted by rolling the lower end of the body panel member 112 in the direction of the body height support length(S).

In exemplary embodiments, the initial or maximum body height support length S of the body panel member 110 is about 50 cm. The waist support member 120 including the waist textile strap 122 has a height, parallel to the direction of the body support length S of the body panel member 110, which is about 10 cm. The height of the waist textile strap 122 is about 20% of the maximum body support length S.

The waist support member may be turned a number of half turns, in a direction as indicated by arrow T, before connecting the waist support member including the body panel member 110 to the waist of the person.

In case the waist support member has not been turned, i.e. zero times, the body support length S of the body panel member 110 is about 50 cm. In case the waist support member has been turned a half turn, i.e. one time, the body support length S of the body panel member 110 is about 40 cm. Likewise, in case the waist support member has been turned a whole turn, i.e. two times a half turn, the body support length S of the body panel member 110 is about 30 cm.

In this way, body support length S of the body panel member 110 is adjustable between the maximum body support length S and less than the maximum body support length S.

A user may selectively adjust the body support length S of the body panel member 110 based on a size and/or weight of a baby or young child to be carried by the baby carrier 100.

Additionally, the user may selectively adjust the body support length S of the body panel member 110 based on a desired height level of the baby carrier 100 and/or the baby with respect to the body of the carrying person based on a desired position of the baby carrier with respect to the body of the carrying person, such as a front position, a back position and a side position with respect to the body of the carrying person.

For example, a desired front height level of the baby with respect to the body of the carrying person in a front position may be such that the carrying person may look over the head of the baby. In another example, a desired back height level of the baby with respect to the body of the carrying person in a back position may be such that the baby or young child may look over the shoulder of the carrying person.

Additionally, the user may selectively adjust a width of the lower end of the body panel member 112 to provide a desired width depending on the hips and legs of the baby to be carried.

In all of these embodiments, the woven fabric of the body panel member has a thickness, which is less than 5 mm. The body panel member 110 is foldable and rollable. This supports an easy adjusting of the body support length S of the body panel member 110 and a width of the lower end of the body panel member 112.

In all of these embodiments, the waist textile strap 122 of the waist support member has an effective thickness, which is less than 5 mm. An effective thickness is defined as a thickness in a state, wherein the waist support member is worn on the body of the person. During wearing a pressure may be acting on the waist textile strap, which reduces an initial thickness to a smaller effective thickness. For example, a compressible waist textile strap 122 may have an initial thickness of about 5 to 8 mm, while during wearing of the baby carrier the effective thickness of the waist textile strap 122 is reduced to 5 mm or less.

An effective thickness which is less than 5 mm supports an easy adjusting of the body support length S of the body panel member 110.

In all of these embodiments, the woven fabric has a weave structure selected from one of a diagonal weave, a double diagonal weave and a jacquard weave.

In all of these embodiments, the woven fabric is predominantly made of a natural yarn, in particular a natural yarn selected from the group consisting of wool, cotton, linen, silk, and hemp, a silver coated yarn, in particular a silver coated yarn selected from the group consisting of silver coated wool, silver coated cotton, silver coated linen, silver coated silk, and silver coated hemp, a viscose yarn, in particular a viscose yarn made from a material selected from the group consisting of bamboo, coffee, wood, and seaweed, or a reflective nanoparticle coated yarn.

In all of these embodiments, the woven fabric comprises a yarn having a weight of at least 200 g/m, preferably of at least 300 g/m. The weight of the yarn supports a comfortable carrying of the baby and/or the young child by the baby carrier 100.

The embodiment shown in FIG. 1 further comprises a fastening assembly 170 attached to an outer surface of the body panel member 110. The fastening assembly 170 is arranged at a height level, i.e. in a direction along the body support length S of the body panel member 110, below the side fastening members 150, 160 for releasably fastening the mechanical fastening means 136, 146 of the shoulder fastening members 130, 140 to the body panel member 110.

The fastening assembly 170 comprises a pair of belt guiding loops 172, 174 attached to the outer surface of the body panel member 110, each belt guiding loop arranged for guiding and positioning a belt of one of the shoulder fastening members, when fastening the mechanical fastening means 136, 146 of the two shoulder fastening members 130, 140 to one another.

In a modified embodiment, the support layer of the body panel member, the shoulder strap and the waist textile strap is mainly constituted by two layers of the woven fabric. The baby carrier has the same elements as the baby carrier 100 as shown in FIG. 1, i.e. comprises a body panel member 110, a pair of shoulder fastening members 130, 140, a pair of side fastening members 150, 160, and a waist support member 120.

Figure 2:
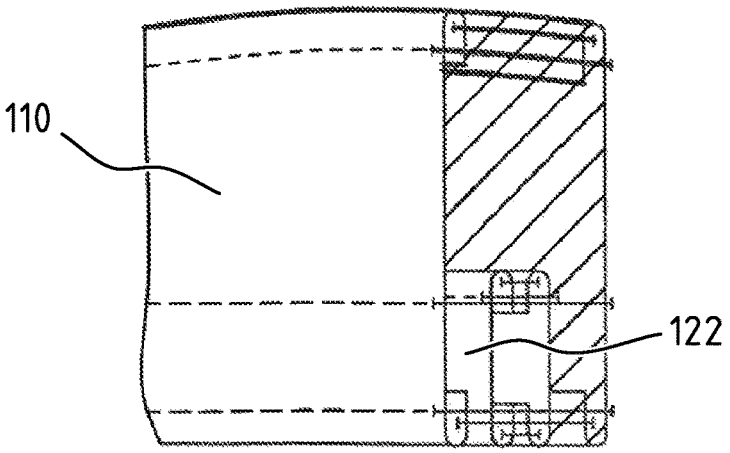
FIG. 2 illustrates schematically a cross section of the baby carrier shown in FIG. 1 according to another exemplary embodiment of the present invention.

Additionally, the support layers of the body panel member 110, the shoulder straps 132, 142 and the waist textile strap 122 are mainly constituted by two layers of the woven fabric. FIG. 2 shows schematically an assembly of the layers of the body panel member 110 and the waist textile strap 122 at a cross section along the line II-II as shown in FIG. 1.

As shown in FIG. 2, the waist textile strap 122 is a separate strap connected to the body panel member 110 along the lower end of the body panel member and is extending from both sides of the body panel member 110. As shown in FIG. 2, the waist textile strap 122 is partly enclosed by layers of the woven fabric of the support layer of the body panel member 110. This supports an easy and reliable adjusting of the body support length S of the body panel member 110.

(Use of the Baby Carrier)

In a specific use of the baby carrier 100, the baby carrier is worn in a desired front, back or side position with respect to the carrying person. The method for using the baby carrier comprises the steps of:

(i) optionally adjusting a body height support length(S) of the body panel member 110 by folding or rolling the lower end of the body panel member 112 in the direction of the body height support length(S), before tightening the waist support member including the body panel member 110 to the waist of the person;

(ii) fastening the waist support member 120 including the body panel member 110 to the waist of the person;

(iii) placing the baby inside the baby carrier;

(iv) fastening the male fastening means 136 of said one shoulder fastening member 130 to the female fastening means 154 of said another one side fastening member 150 and the female fastening means 146 of said another one shoulder fastening member 140 to the male fastening means 164 of said one side fastening member 160;

(v) supporting the shoulder fastening members 130, 140 on the shoulders of the person; and (vi) carrying a baby inside the baby carrier on the body of a person.

During step (i) the belt of the waist support member may be already connected while the waist support member including the body panel member is not tightened to the waist of the person. At least the waist support member must allow the body panel member to be folded or rolled. Before step (iv) the belt length of the shoulder fastening member may be increased by sliding the fastening member along the belt and/or the belt length of the side fastening member may be increased by sliding the fastening member along the belt. In this way the user may during step (iv) easily grasp the corresponding male and female fastening means to connect them and in a subsequent step pull one of the belt ends to tighten the belts.

Step (v) supporting the shoulder fastening members 130, 140 on the shoulders of the person may be carried out before step (iv) or after step (iv).

(Front Wearing Positions)

Figure 3A:
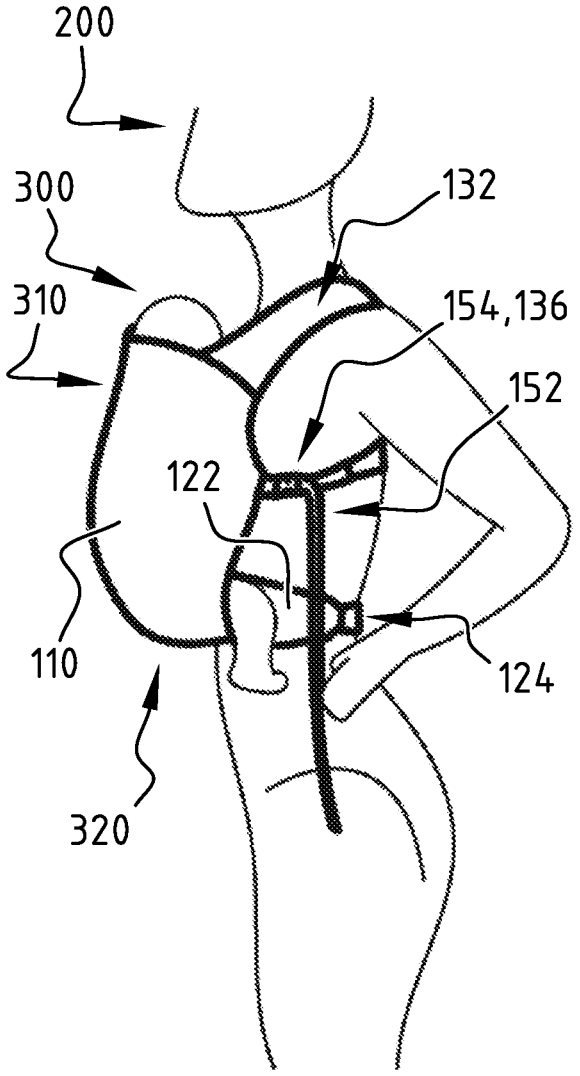
FIGS. 3A-3C illustrate schematically a use of a baby carrier according to an embodiment of the present invention.
Figure 3B:
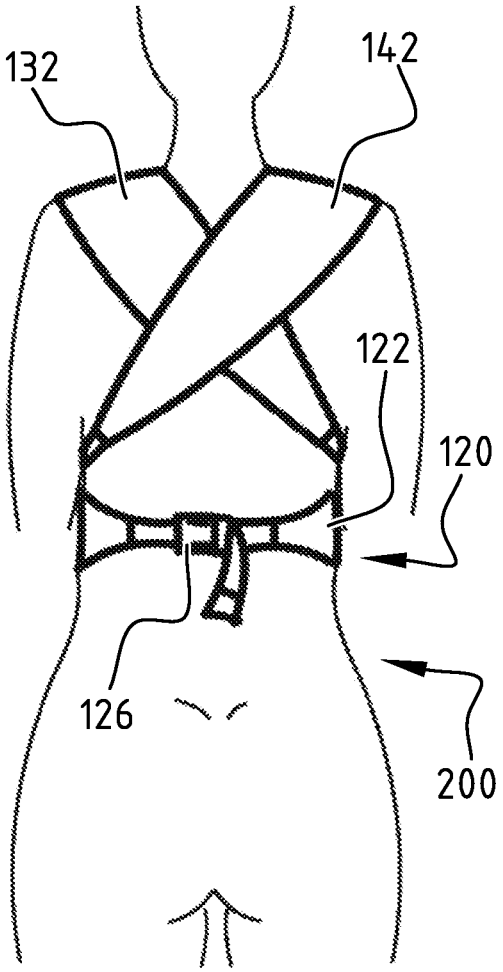
Figure 3C:
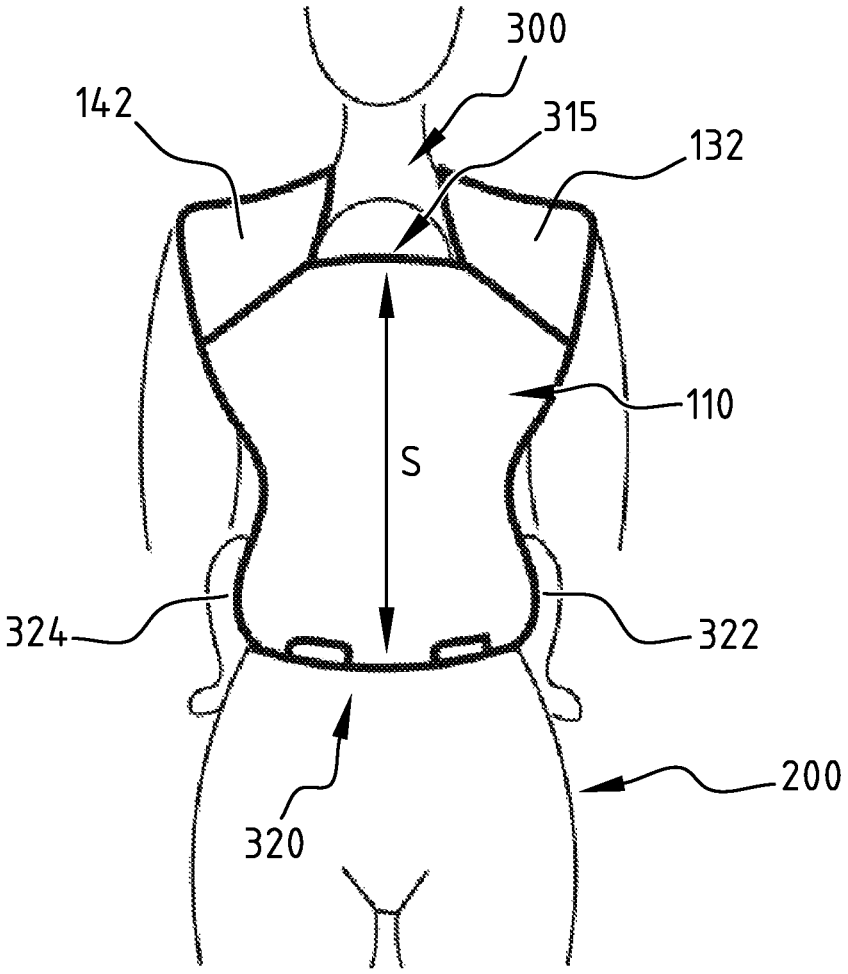

FIGS. 3A-3C illustrate schematically a use of a baby carrier according to an embodiment of the present invention. The use is a basic front wearing position with respect to the carrying person 200.

The baby carrier shown 100 is the baby carrier of FIG. 1.

The shoulder straps are crossed at the back (as shown in FIG. 3B). The male fastening means 136 of said one shoulder fastening member 130 is connected to the female fastening means 154 of said another one side fastening member 150 and the female fastening means 146 of said another one shoulder fastening member 140 is connected to the male fastening means 164 of said one side fastening member 160. In alternative embodiments of the baby carrier 100, the male fastening means and the female fastening means may be interchanged.

The body height support length(S) of the body panel member 110 is adjusted to support a spine shape 310 of the baby 300 and the width of the body panel member 110 at the lower end of the body panel member 110 is adjusted to support a hip 320 and legs 322, 324 of the baby 300.

Figure 4A:
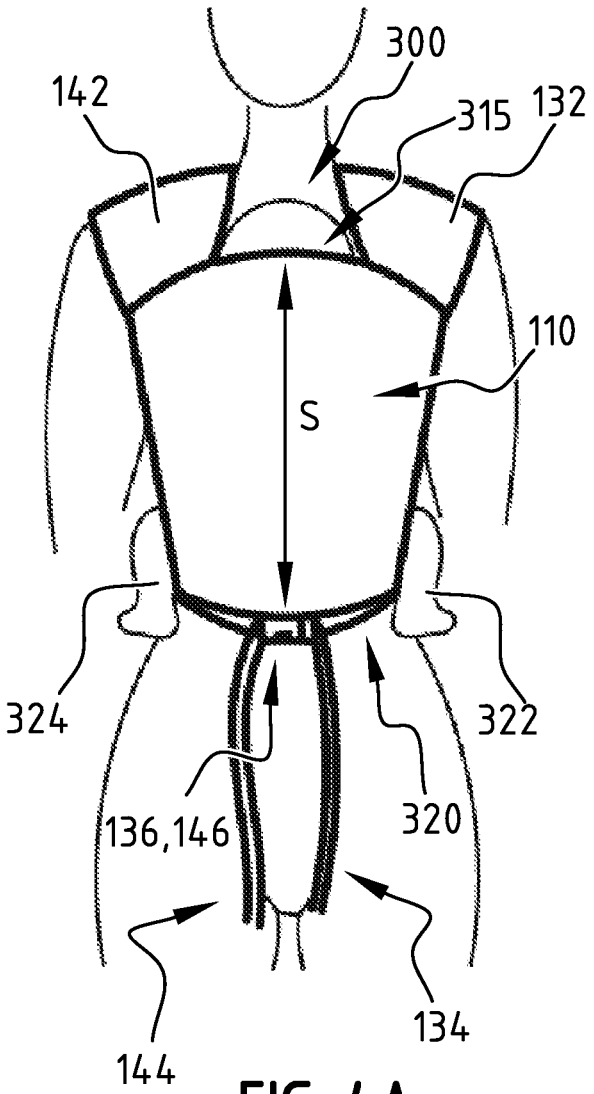
FIGS. 4A-4B illustrate schematically a use of a baby carrier according to another embodiment of the present invention.
Figure 4B:
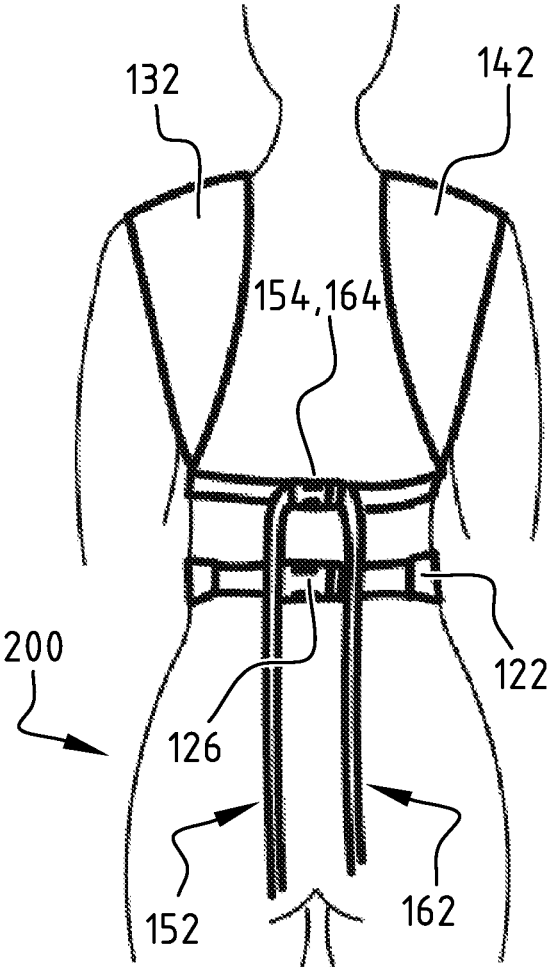

FIGS. 4A-4B illustrate schematically a use of a baby carrier according to another embodiment of the present invention. The use is a under bum front wearing position with respect to the carrying person 200. The baby carrier shown 100 is the baby carrier of FIG. 1.

The body height support length(S) of the body panel member 110 is adjusted to support a spine shape 310 of the baby 300 and the width of the body panel member 110 at the lower end of the body panel member 110 is adjusted to support a hip 320 and legs 322, 324 of the baby 300.

The shoulder straps are arranged parallel to one another (H-position) (as shown in FIG. 4B) moved under the arms to the front and the fastening means 136, 146 are moved under the bum of the baby near the hip position 320 of the baby. The male fastening means 136 of said one shoulder fastening member 130 is connected to the female fastening means 146 of said another one shoulder fastening member 140 at the front. The fastening means 154, 164 of the side fastening members 150, 160 are connected to one another. The shoulder fastening members 130, 140 are tightened to provide a top rail support 315.

Figure 5:
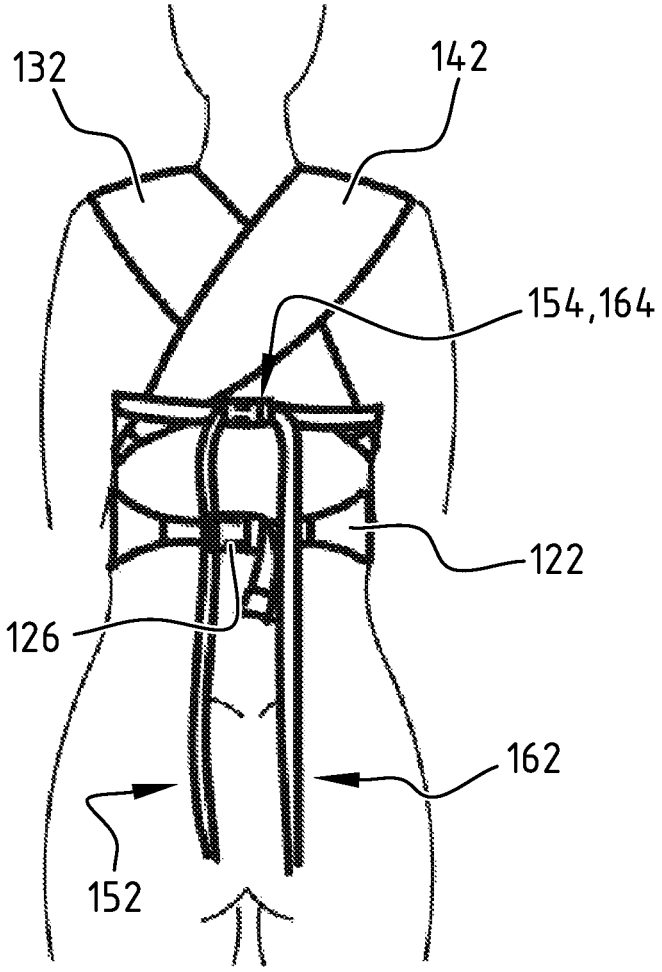
FIG. 5 illustrates schematically a use of a baby carrier according to another embodiment of the present invention.

FIG. 5 illustrates schematically a use of a baby carrier according to another embodiment of the present invention. The use is an alternative under bum front wearing position with respect to the carrying person 200. The baby carrier shown 100 is the baby carrier of FIG. 1.

The shoulder straps are crossed at the back (as shown in FIG. 5) moved under the arms to the front and the fastening means 136, 146 are moved under the bum of the baby near the hip position 320 of the baby (the same as shown in FIG. 4). The male fastening means 136 of said one shoulder fastening member 130 is connected to the female fastening means 146 of said another one shoulder fastening member 140 at the front. The fastening means 154, 164 of the side fastening members 150, 160 are connected to one another. The shoulder fastening members 130, 140 are tightened to provide a top rail support 315 (the same as shown in FIG. 4).

(Back Wearing Positions)

Figure 6A:
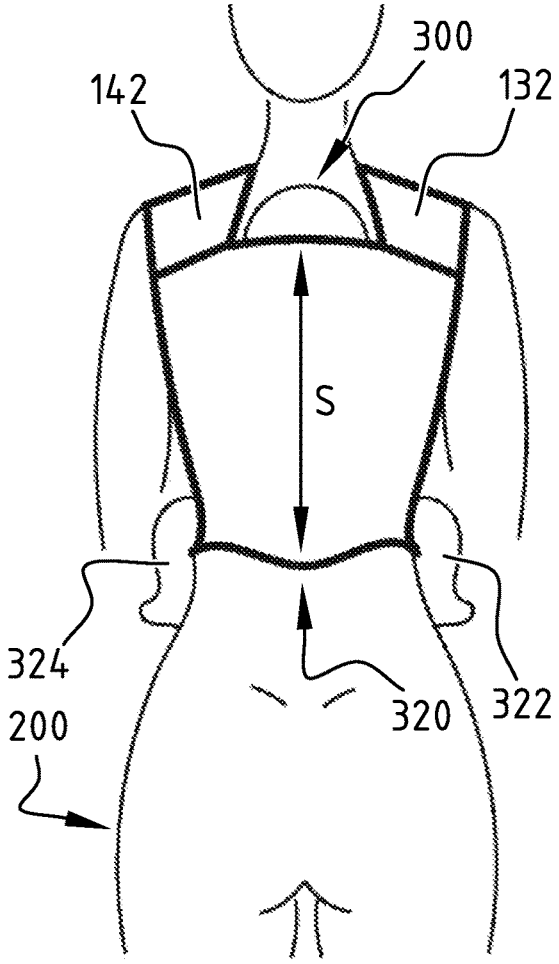
FIGS. 6A-6B illustrate schematically a use of a baby carrier according to another embodiment of the present invention.
Figure 6B:
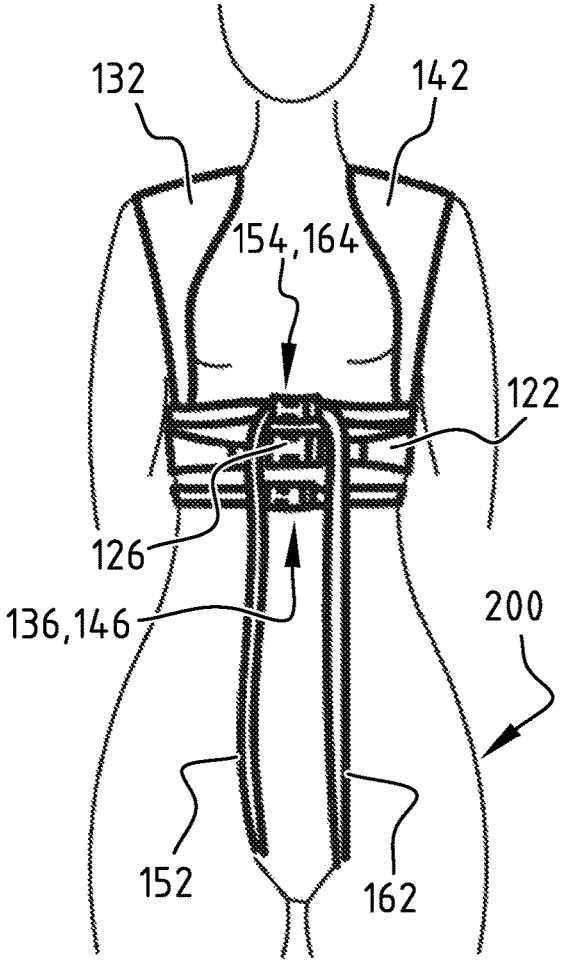

FIGS. 6A-6B illustrate schematically a use of a baby carrier according to another embodiment of the present invention. The use is a Mei tai back wearing position with respect to the carrying person 200. The baby carrier shown 100 is the baby carrier of FIG. 1.

The shoulder straps are arranged parallel to one another (H-position) (as shown in FIG. 6B) moved under the arms to the back and the fastening means 136, 146 are moved crossing the back towards the front. The male fastening means 136 of said one shoulder fastening member 130 is connected to the female fastening means 146 of said another one shoulder fastening member 140 at the front. The fastening means 154, 164 of the side fastening members 150, 160 are connected to one another and may act as a chest strap. The shoulder fastening members 130, 140 are tightened to provide a top rail support 315.

Figure 8A:
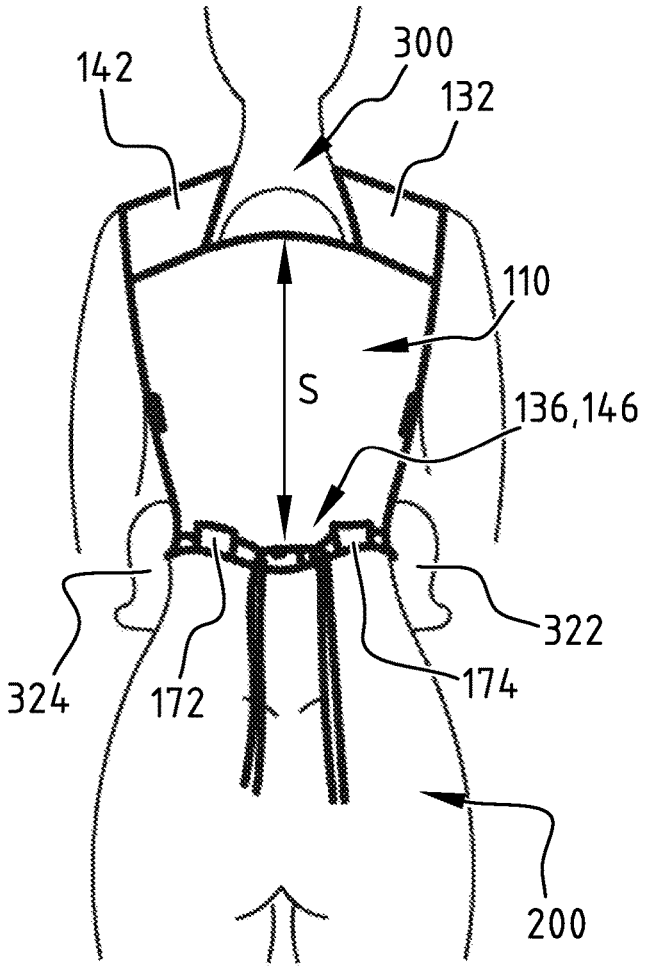
FIGS. 8A-8B illustrate schematically a use of a baby carrier according to another embodiment of the present invention.
Figure 8B:
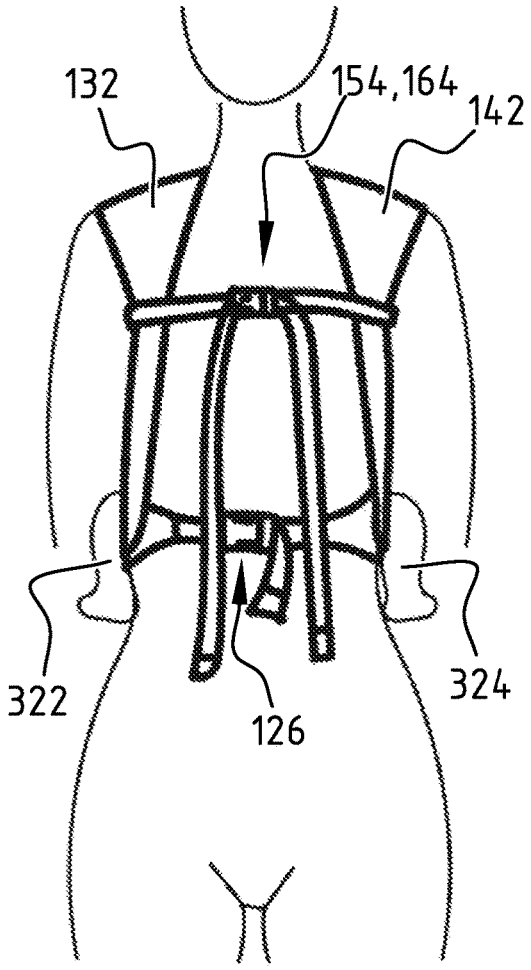

FIGS. 8A-8B illustrate schematically a use of a baby carrier according to another embodiment of the present invention. The use is a pre-buckled back wearing position with respect to the carrying person 200. The baby carrier shown 100 is the baby carrier of FIG. 1.

In this embodiment first the fastening means 136, 146 of the shoulder fastening members 130, 140 are guided through the guiding loops 172, 174 before connecting the male fastening means 136 of said one shoulder fastening member 130 to the female fastening means 146 of said another one shoulder fastening member 140. This may be carried out as a pre-bluckling step before use. The shoulder straps are arranged parallel to one another (H-position) (as shown in FIG. 8B) moved under the arms to the back and the fastening means 136, 146 are moved under the bum of the baby near the hip position 320 of the baby. For H-buckling it is possible to do the pre-buckling order.

The fastening means 154, 164 of the side fastening members 150, 160 are connected to one another and used as chest belt. The shoulder fastening members 130, 140 are tightened to provide a top rail support 315.

Figure 9A:
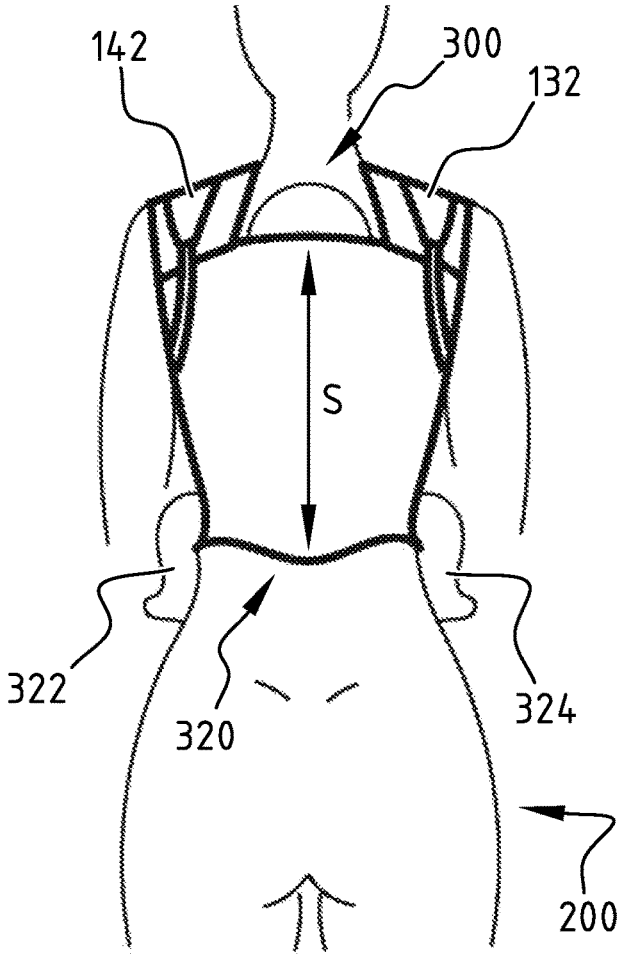
FIGS. 9A-9B illustrate schematically a use of a baby carrier according to another embodiment of the present invention.
Figure 9B:
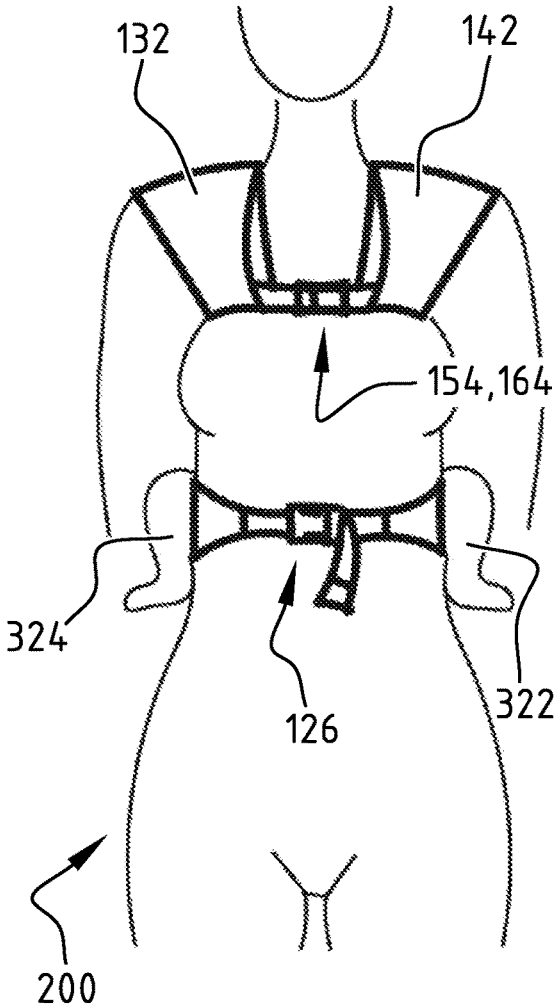

FIGS. 9A-9B illustrate schematically a use of a baby carrier according to another embodiment of the present invention. The use is a torso carry back wearing position with respect to the carrying person 200. The baby carrier shown 100 is the baby carrier of FIG. 1.

The shoulder straps are arranged parallel to one another (H-position) (as shown in FIG. 9B). The fastening means 154, 164 of the side fastening members 150, 160 are connected to one another and used as chest belt. The shoulder straps are flipped under the chest belt and the belts of the shoulder fastening members 130, 140 do not need to be connected or tightened.

In each of the back wearing positions a step may be carried out of adjusting the length of the belts 134, 144 such that the baby carrier including the baby is arranged at a desired back height level. Such a desired back height level of the baby with respect to the body of the carrying person in a back position is such that the baby or young child may look over the shoulder of the carrying person.

(Side Wearing Position)

Figure 7A:
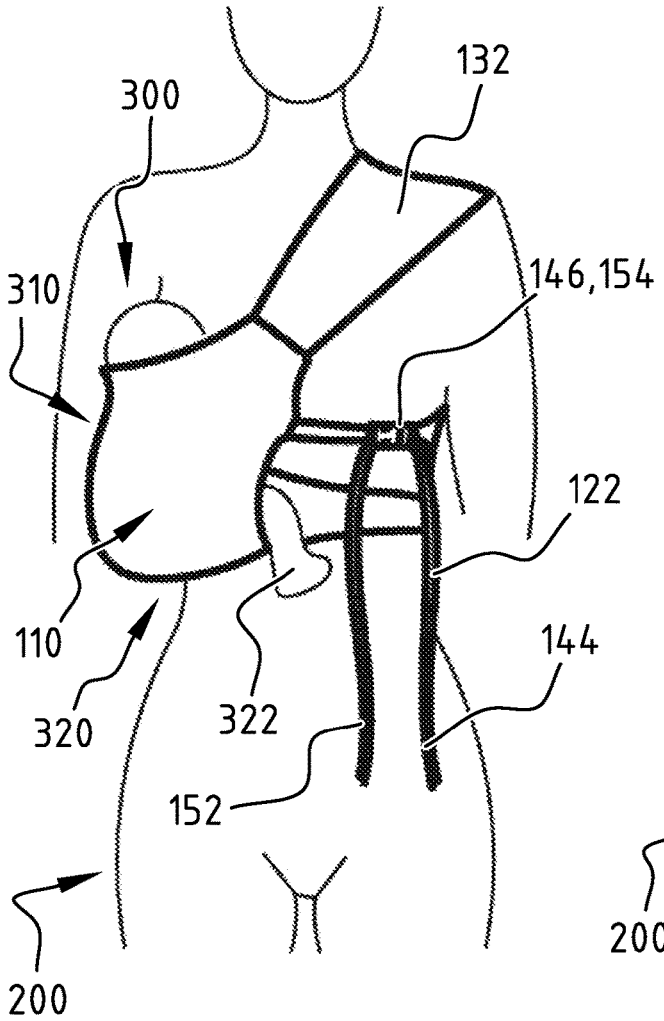
FIGS. 7A-7B illustrate schematically a use of a baby carrier according to another embodiment of the present invention.
Figure 7B:
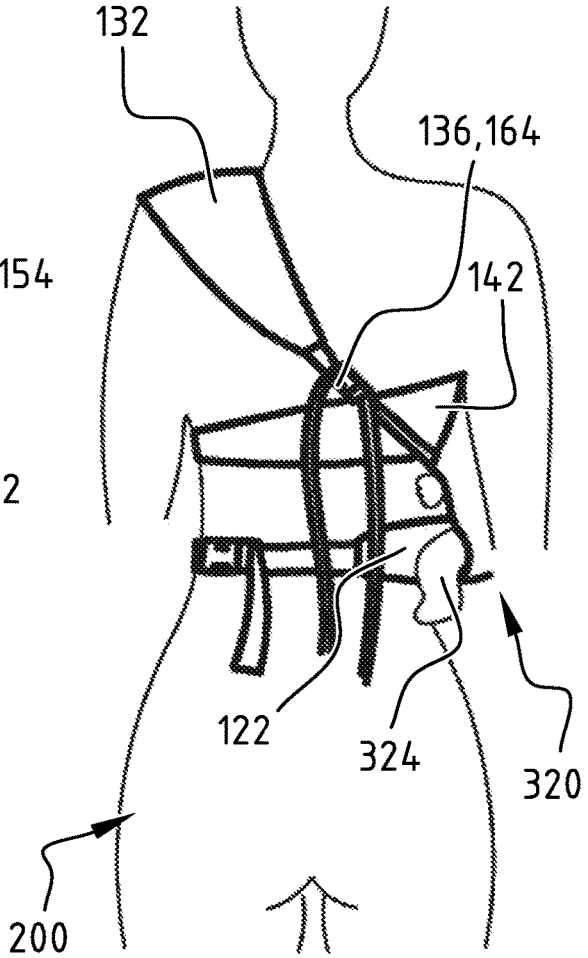

FIGS. 7A-7B illustrate schematically a use of a baby carrier according to another embodiment of the present invention. The use is a side or hip wearing position with respect to the carrying person 200. The baby carrier shown 100 is the baby carrier of FIG. 1.

The shoulder fastening member 130 is connected to the side fastening members 160 at the back and the shoulder fastening member 140 is connected to the side fastening members 150 at the side or front of the carrying person 200.

This position is beneficial for 3 months old baby and for children who are not yet adapted to the M-hip position of the basic front carry position.

Table 1 shows the details of the use of the baby carrier in specific positions

TABLE 1 use details of the baby carrier in specific positions

| Position | Name | Infant age | Shoulder strap pass | Shoulder belt length need Parent size XXL+ | Side belt length need Parent size XXL+ |
|---|---|---|---|---|---|
| 1 | Basic front carry | 0-18 months | X | 100 cm | 100 cm |
| 2 | Under bum tie | 0-6 months | X | 110 cm | 100 cm |
| 3 | H-strap front carry | 9+ months | H | 100 cm | 100 cm |
| 4 | Hip Carry | 3+ months | Y | 120 cm | 100 cm |
| 5 | Pre-buckled Back Carry | 3+ months | H | 120 cm | 100 cm |
| 6 | Mei Tai Ruck Back Carry | 3+ months | H | 120 cm | 100 cm |
| 7 | Torso Carry | 3+ months | — | 70 cm | 100 cm |

The shoulder strap length for all positions is 50 cm. The desired length of the shoulder belt is 100-120 cm, especially for the Under bum tie position, the Hip Carry position, the Pre-buckled Back Carry position and the Mei Tai Ruck Back Carry position.

The desired length for the side belt (chest belt) is about 100 cm for Parent Size XXL+. The shoulder belt length and the side (chest) belt length depend on the parent size and will be smaller for smaller Parent Size.

In all of the embodiments shown, at least one of the body panel member, the shoulder strap and the waist textile strap may further comprise an inner contact layer comprising a fabric different from the support layer. The inner contact layer is arranged for contacting the baby and/or carrying person. The inner contact fabric may be suitably chosen based on at least one factor of softness, breathability, thermal regulation, washability, anti-bacterial, and anti-eczema qualities. This enables proper thermal regulation of the child in both hot and cold temperatures, increases the hygienic cleanliness and health of parent and child, can help reduce child eczema, and ensures long-term quality after many washes.

It should be appreciated by those skilled in the art that any block diagrams herein represent conceptual views of illustrative units or modules embodying the principles of the invention.

Whilst the principles of the invention have been set out above in connection with specific embodiments, it is to be understood that this description is merely made by way of example and not as a limitation of the scope of protection which is determined by the appended claims.

The invention claimed is:

1. A baby carrier for carrying and developing a baby on a body of a person, said baby carrier comprising:

a body panel member shaped for providing a seat for a baby and a back support for the baby, wherein the body panel member comprises a support layer mainly constituted by a woven fabric;

a waist support member connected to a lower end of the body panel member for fastening the body panel member to a waist of the person;

a pair of shoulder fastening members connected to an upper end of the body panel member and arranged for fastening the body panel member over each shoulder of the person, respectively;

a pair of side fastening members, each side fastening member being connected to a side of the body panel member, respectively, and comprising a fastening means, wherein the fastening means of one side fastening member has a male element and the fastening means of another one side fastening member has a corresponding female element;

wherein each shoulder fastening member comprises: a shoulder strap arranged for extending over a shoulder, respectively, wherein the shoulder strap comprises a support layer constituted by a woven fabric; a belt and a fastening means mounted onto the belt for releasably connecting the belt to one of the side fastening members or to the fastening means of another one of the shoulder fastening member, wherein the fastening means of one shoulder fastening member has a male element and the fastening means of another shoulder fastening member has a corresponding female element, and wherein the fastening means is slidably arranged for adjusting a belt length between the fastening means and the shoulder strap;

wherein the waist support member including the body panel member are arranged for selectively adjusting a body height support length of the body panel member, by selectively folding or rolling the lower end of the body panel member in the direction of the body height support length before tightening the waist support member including the body panel member to the waist of the person;

wherein the male fastening means of the shoulder fastening member and the male mechanical fastening means of the side fastening member are both arranged at a same first side of the body panel member and the female fastening means of the other shoulder fastening member and the female mechanical fastening means of the other side fastening member are both arranged at a same second side of the body member panel, and wherein both the male fastening means of the shoulder fastening member and the male mechanical fastening means of the side fastening member can be connected with both the female fastening means of the other shoulder fastening member and the female mechanical fastening means of the other side fastening member, and wherein the baby carrier is arranged so as to be configurable into:

a basic front wearing position in which the shoulder straps are crossed at the back, wherein the male fastening means of said one shoulder fastening member is connected to the female fastening means of said another one side fastening member and the female fastening means of said another one shoulder fastening member is connected to the male fastening means of said one side fastening member, wherein the body height support length(S) of the body panel member is adjusted to support a spine shape of the baby and the width of the body panel member at the lower end of the body panel member is adjusted to support a hip and legs of the baby;

an under bum front wearing position in which the body height support length(S) of the body panel member is adjusted to support a spine shape of the baby and the width of the body panel member at the lower end of the body panel member is adjusted to support a hip and legs of the baby, wherein the shoulder straps are arranged parallel to one another and moved under the arms to the front and the fastening means are moved under the bum of the baby near the hip position of the baby, wherein the male fastening means of said one shoulder fastening member is connected to the female fastening means of said another one shoulder fastening member at the front, wherein the fastening means of the side fastening members are connected to one another, and wherein the shoulder fastening members are tightened to provide a top rail support;

an alternative under bum front wearing position in which the shoulder straps are crossed at the back and moved under the arms to the front and the fastening means are moved under the bum of the baby near the hip position of the baby, wherein the fastening means of said one shoulder fastening member is connected to the female fastening means of said another one shoulder fastening member at the front, wherein the fastening means of the side fastening members are connected to one another, and wherein the shoulder fastening members are tightened to provide a top rail support, a Mei tai back wearing position in which the shoulder straps are arranged parallel to one another and moved under the arms to the back and the fastening means are moved crossing the back towards the front, and the male fastening means of said one shoulder fastening member is connected to the female fastening means of said another one shoulder fastening member at the front, wherein the fastening means of the side fastening members are connected to one another and may act as a chest strap, and wherein the shoulder fastening members are tightened to provide a top rail support;

a side or hip wearing position in which the shoulder fastening member is connected to the side fastening members at the back and the shoulder fastening member is connected to the side fastening members at the side or front of the carrying person;

a pre-buckled back wearing position in which the fastening means of the shoulder fastening members are guided through the guiding loops before connecting the male fastening means of said one shoulder fastening member to the female fastening means of said another one shoulder fastening member, the shoulder straps are arranged parallel to one another and moved under the arms to the back and the fastening means are moved under the bum of the baby near the hip position of the baby, wherein the fastening means of the side fastening members are connected to one another and used as chest belt, and wherein the shoulder fastening members are tightened to provide a top rail support; and a torso carry back wearing position in which the shoulder straps are arranged parallel to one another, the fastening means of the side fastening members are connected to one another and used as chest belt, and the shoulder straps are flipped under the chest belt and the belts of the shoulder fastening members do not need to be connected or tightened.

2. The baby carrier according to claim 1, wherein the waist support member including the body panel member are arranged for selectively rolling the lower end of the body panel member in the direction of the body height support length.

3. The baby carrier according to claim 1, wherein the waist support member comprises at least one waist textile strap, the at least one waist textile strap being arranged on at least one side, at the lower end of the body panel member extending along at least a part of the waist support member, wherein the at least one waist textile strap is foldable and rollable.

4. The baby carrier according to claim 3, wherein the waist textile strap of the waist support member has an effective thickness, which is less than 5 mm, and wherein the waist textile strap comprises a support layer mainly constituted by a woven fabric.

5. The baby carrier according to claim 3, wherein the waist textile strap is partly enclosed by layers of the body panel member.

6. The baby carrier according to claim 3, wherein the waist textile strap is a separate strap connected to the body panel member at the lower end of the body panel member or wherein the waist textile strap is a part of the body panel member.

7. The baby carrier according to claim 3, wherein a height of the waist textile strap provides a folding distance for the body panel member, when turning the waist textile strap, which is at most 25% of the maximum body height support length of the body panel member.

8. The baby carrier according to claim 3, wherein a height of the waist textile strap is at most 15 cm.

9. The baby carrier according to claim 3, wherein the waist support member further comprises a belt, optionally connected to the waist textile strap, and a fastening means arranged for releasable fastening the waist support member to the waist of the person.

10. The baby carrier according to claim 3, wherein the woven fabric of the body panel member has a thickness, which is less than 5 mm, and the support layer of at least one of the body panel member, the shoulder strap and the waist textile strap is mainly constituted by a number of layers of the woven fabric.

11. A use of the baby carrier according to claim 1, for supporting a baby on a body of a person, the use comprising the steps of:

adjusting a body height support length of the body panel member by folding or rolling the lower end of the body panel member in the direction of the body height support length, before tightening the waist support member including the body panel member to the waist of the person;

fastening the waist support member including the body panel member to the waist of the person;

placing the baby inside the baby carrier;

fastening the male fastening means of said one shoulder fastening member to the female fastening means of said another one side fastening member and the female fastening means of said another one shoulder fastening member to the male fastening means of said one side fastening member;

supporting the shoulder fastening members on the shoulders of the person; and carrying a baby inside the baby carrier on the body of a person.

12. A use of the baby carrier according to claim 1, for supporting a baby on a body of a person, wherein the body panel member further comprises a fastening assembly attached to an outer surface of the body panel member, wherein the fastening assembly comprises a pair of belt guiding loops, the use comprising the steps of:

adjusting a body height support length of the body panel member by folding or rolling the lower end of the body panel member in the direction of the body height support length, before tightening the waist support member including the body panel member to the waist of the person;

fastening the waist support member including the body panel member to the waist of the person;

placing the baby inside the baby carrier;

guiding each of the belts of the shoulder fastening members through at least one of the belt guiding loops attached to the outer surface of the body panel member;

fastening the male fastening means of said one shoulder fastening member to the female fastening means of said another one shoulder fastening member;

supporting the shoulder fastening members on the shoulders of the person;

optionally fastening the male fastening means of said one side fastening member to the female fastening means of said another one side fastening member; and carrying a baby inside the baby carrier on the body of a person.

13. A use of wearing the baby carrier according to claim 1, for supporting a baby on a body of a person, wherein the body panel member further comprises a fastening assembly attached to an outer surface of the body panel member, the fastening assembly being arranged for releasably fastening the fastening means of the shoulder fastening members to the body panel member, the use comprising:

adjusting a body height support length of the body panel member by folding or rolling the lower end of the body panel member in the direction of the body height support length, before tightening the waist support member including the body panel member to the waist of the person;

fastening the waist support member including the body panel member to the waist of the person;

placing the baby inside the baby carrier;

fastening the fastening means of said one shoulder fastening member to the fastening assembly and fastening the fastening means of said another one shoulder fastening member to the fastening assembly, thereby attaching the shoulder fastening members to the outer surface of the body panel member;

supporting the shoulder fastening members on the shoulders of the person;

optionally fastening the male fastening means of one side fastening member to the female fastening means of another one side fastening member; and carrying a baby inside the baby carrier on the body of a person.

14. The baby carrier according to claim 1, wherein the woven fabric has a weave structure selected from one of a diagonal weave, a double diagonal weave and a jacquard weave.

15. The baby carrier according to claim 14, wherein the woven fabric is predominantly made of a natural yarn selected from the group consisting of wool, cotton, linen, silk, and hemp, a silver coated yarn selected from the group consisting of silver coated wool, silver coated cotton, silver coated linen, silver coated silk, and silver coated hemp, a viscose yarn made from a material selected from the group consisting of bamboo, coffee, wood, and seaweed, or a reflective nanoparticle coated yarn.

16. The baby carrier according to claim 1, wherein the woven fabric comprises a yarn having a weight of at least 150 g/m.

17. The baby carrier according to claim 1, wherein at least one of the body panel member, the shoulder strap and the waist textile strap further comprises an inner contact layer comprising a fabric different from the support layer.

18. The baby carrier according to claim 1, wherein the shoulder strap is connected to the body panel member such that the shoulder strap comprises a pleat, wherein said pleat is arranged for selectively adjusting a wearing width of the shoulder strap, when wearing the shoulder strap on a shoulder of the carrying person.

19. The baby carrier according to claim 1, wherein a width of the shoulder strap is at least 10 cm and at most 20 cm, and an extension length of the shoulder strap is at most 105 cm, and at least 40 cm, and a length of the belt of the shoulder fastening member is at least 80 cm.

20. The baby carrier according to claim 1, wherein at least one side fastening member comprises a belt, wherein the fastening means is slidably mounted onto the belt for adjusting a belt length between the fastening means and the body panel member, and a length of the belt of the side fastening member is at least 80 cm, wherein the belt length between the fastening means and the body panel member is adjustable in a range between 0 cm and 80 cm.

21. The baby carrier according to claim 1, wherein the fastening means is selected from at least one of a buckle member, a clasp member, a press stud member, a magnet member and a plurality of male fastening elements capable of engaging with fibrous materials having a plurality of complementary female fastening elements.

22. The baby carrier according to claim 1, wherein the baby carrier can be carried in at least four wearing positions.

* * * * *